US012467002B2

(12) United States Patent
Imshenetskii et al.

(10) Patent No.: US 12,467,002 B2
(45) Date of Patent: Nov. 11, 2025

(54) METHOD FOR PRODUCING GASOLINES OR AROMATIC COMPOUND CONCENTRATES WITH DIFFERENT DISTRIBUTION OF HYDROCARBON, OXYGENATE AND OLEFIN-CONTAINING FRACTIONS TO THE REACTOR BEDS

(71) Applicant: NGT Global AG, St Andres (CH)

(72) Inventors: Vladimir Vladislavovich Imshenetskii, Moscow (RU); Elena Nikolaevna Lobichenko, Lobnya (RU); Denis Vasilevich Pchelintsev, Moscow (RU); Iosif Izrailevich Lishchiner, Moscow (RU); Andrei Leonidovich Tarasov, Moscow (RU); Olga Vasilevna Malova, Moscow (RU); Dmitrii Valerevich Ivanov, Novosibirsk (RU); Aleksandr Anatolevich Bessonov, Odintsovo (RU)

(73) Assignee: Universal Fuel Technologies, Inc., Los Altos, CA (US)

( * ) Notice: Subject to any disclaimer, the term of this patent is extended or adjusted under 35 U.S.C. 154(b) by 0 days.

(21) Appl. No.: 18/013,533

(22) PCT Filed: Jun. 22, 2021

(86) PCT No.: PCT/RU2021/050177

§ 371 (c)(1),
(2) Date: Dec. 28, 2022

(87) PCT Pub. No.: WO2022/005331

PCT Pub. Date: Jan. 6, 2022

(65) Prior Publication Data

US 2023/0257663 A1 Aug. 17, 2023

(30) Foreign Application Priority Data

Jun. 29, 2020 (RU) ..... 2020121543

(51) Int. Cl.
*C10G 3/00* (2006.01)

(52) U.S. Cl.
CPC ..... *C10G 3/49* (2013.01); *C10G 3/60* (2013.01); *C10G 2300/1037* (2013.01); *C10G 2300/1092* (2013.01); *C10G 2300/1096* (2013.01); *C10G 2400/02* (2013.01); *C10G 2400/30* (2013.01)

(58) Field of Classification Search
None
See application file for complete search history.

(56) References Cited

U.S. PATENT DOCUMENTS 3,702,886 A 11/1972 Argauer
3,756,942 A 9/1973 Cattanach
3,911,041 A 10/1975 Kaeding
3,941,871 A 3/1976 Dwyer
4,159,282 A 6/1979 Olson
4,211,640 A 7/1980 Garwood
4,227,992 A 10/1980 Garwood
4,356,338 A 10/1982 Young
4,456,527 A 6/1984 Buss
4,463,204 A 7/1984 Liu
4,465,886 A 8/1984 Rodewald
4,499,314 A 2/1985 Seddon
4,523,049 A 6/1985 Jones
4,554,260 A 11/1985 Pieters
4,590,321 A 5/1986 Chu
4,720,602 A 1/1988 Chu
4,853,202 A 8/1989 Kuznicki
4,899,011 A 2/1990 Chu
4,963,337 A 10/1990 Zones
5,108,579 A 4/1992 Casci
5,173,461 A 12/1992 Absil
5,178,748 A 1/1993 Casci
5,306,411 A 4/1994 Mazanec
5,321,183 A 6/1994 Chang
5,362,697 A 11/1994 Fung
5,365,003 A 11/1994 Chang
5,453,554 A 9/1995 Chang
5,498,814 A 3/1996 Chang
5,516,736 A 5/1996 Chang
5,536,894 A 7/1996 Degnan
5,557,024 A 9/1996 Cheng
5,935,897 A 8/1999 Trubenbach
5,993,642 A 11/1999 Mohr
6,046,372 A 4/2000 Brown
6,063,724 A 5/2000 Resasco
6,096,193 A 8/2000 Resasco
6,143,166 A 11/2000 Nacamuli
6,413,898 B1 7/2002 Faber
(Continued)

*Primary Examiner* — Tam M Nguyen

(74) *Attorney, Agent, or Firm* — Glen P. Belvis; Belvis Law, LLC.

(57) ABSTRACT

The invention refers to the method for producing gasolines or aromatic compound concentrates, where three streams are used as feedstock, one of which includes hydrocarbon fraction, the second stream includes oxygenate, the third stream includes olefin-containing fraction with one or more olefins selected from the group consisting of ethylene, propylene, normal butylenes, isobutylene, in total from 10 to 50 wt %, and where three reaction zones filled with zeolite catalyst are used, with distribution of hydrocarbon fraction and oxygenate to the first reaction zone, and with olefin-containing fraction distributed over the three reaction zones, with the third stream mass fraction distributed to the final reaction zone higher than the mass fraction of the third stream distributed to each of the previous reaction zones. This method allows to increase the yield of $C_{5+}$ hydrocarbons, enhance n-hexane and n-heptane conversion, reduce benzene content in the product, avoid recycling of gaseous products and decrease consumption of oxygenates. 1 independent claim and 35 dependent claims in the formula, 12 examples, 7 tables.

36 Claims, No Drawings

(56) References Cited

U.S. PATENT DOCUMENTS

| | | | | |
|---|---|---|---|---|
| 6,423,879 | B1 | 7/2002 | Brown et al. | |
| 6,504,072 | B1 | 1/2003 | Brown et al. | |
| 6,635,792 | B2 | 10/2003 | Choi | |
| 6,906,232 | B2 | 6/2005 | Levin et al. | |
| 6,995,111 | B2 | 2/2006 | Levin et al. | |
| 7,026,263 | B2 | 4/2006 | Le Van Mao | |
| 7,078,578 | B2 | 7/2006 | Janssens et al. | |
| 7,122,492 | B2 | 10/2006 | Ou et al. | |
| 7,122,493 | B2 | 10/2006 | Ou et al. | |
| 7,164,052 | B2 | 1/2007 | Carati et al. | |
| 7,208,442 | B2 | 4/2007 | Xu et al. | |
| 7,419,930 | B2 | 9/2008 | Carati et al. | |
| 7,700,816 | B2 | 4/2010 | Xu et al. | |
| 7,923,399 | B2 | 4/2011 | Long et al. | |
| 8,226,740 | B2 | 7/2012 | Chaumonnot et al. | |
| 8,338,655 | B2 | 12/2012 | Chang | |
| 9,040,003 | B2 | 5/2015 | Matthey | |
| 9,957,203 | B2 * | 5/2018 | Keusenkothen | B01J 8/06 |
| 10,131,592 | B2 | 11/2018 | Lishchiner | |
| 10,550,045 | B2 | 2/2020 | Lishchiner | |
| 10,550,331 | B2 | 2/2020 | Lishchiner | |
| 10,556,846 | B2 | 2/2020 | Imshenetskiy | |
| 11,427,770 | B2 | 8/2022 | Imshenetskiy | |
| 2008/0027255 | A1 | 1/2008 | Blessing et al. | |
| 2008/0300434 | A1 | 12/2008 | Cortright | |
| 2008/0300435 | A1 | 12/2008 | Cortright | |
| 2009/0288990 | A1 | 11/2009 | Xie et al. | |
| 2010/0145127 | A1 | 6/2010 | Xie et al. | |
| 2011/0166303 | A1 * | 7/2011 | Nesterenko | C07C 1/22 526/75 |
| 2011/0196113 | A1 * | 8/2011 | Nesterenko | C07C 1/26 526/75 |
| 2013/0066126 | A1 | 3/2013 | Jana | |
| 2013/0317269 | A1 | 11/2013 | Nesterenko et al. | |
| 2014/0018592 | A1 | 1/2014 | Chen et al. | |
| 2014/0058180 | A1 | 2/2014 | Klingelhofer et al. | |
| 2014/0100404 | A1 | 4/2014 | Narula et al. | |
| 2014/0256010 | A1 | 9/2014 | Narula et al. | |
| 2014/0273146 | A1 | 9/2014 | Narula et al. | |
| 2014/0322781 | A1 | 10/2014 | Narula et al. | |
| 2014/0357912 | A1 * | 12/2014 | Mandal | C10G 11/182 585/302 |
| 2020/0291303 | A1 | 9/2020 | Imshenetskiy | |
| 2024/0076250 | A1 * | 3/2024 | Xu | C10G 11/05 |

* cited by examiner

METHOD FOR PRODUCING GASOLINES OR AROMATIC COMPOUND CONCENTRATES WITH DIFFERENT DISTRIBUTION OF HYDROCARBON, OXYGENATE AND OLEFIN-CONTAINING FRACTIONS TO THE REACTOR BEDS

This application is a US nationalization pursuant to 35 U.S.C. § 371 of PCT/RU2021/050177 filed Jun. 22, 2021, which claims priority to RU patent application No. 2020121543, filed Jun. 29, 2020, the entire disclosure of each of which is entirely incorporated herein by reference.

The invention refers to the field of oil refining and petrochemical industries. More specifically, the invention refers to a method for production of gasolines or aromatic compound concentrates through co-processing hydrocarbon fractions, oxygenates and olefin-containing fractions.

The following terms are used in the description:

Gasoline—commercial gasoline or principal component (base) for the gasoline production. In particular, gasoline produced by the proposed method can be used to obtain motor gasoline by compounding methods (blending of gasoline fractions produced by different oil refining processes). For example, the proposed method can be used to produce the base for motor gasoline of emission class K5, grade AI-92, according to GOST 32513-2013. In some cases, the gasoline produced by the proposed method may not meet all the requirements for commercial gasoline in a particular region or organization. For example, benzene content in the produced gasoline may exceed 1.0 vol. %. As another example, aromatics content of the gasoline produced may exceed 35 vol. %. Liquid hydrocarbon product produced according to the proposed method can be considered as gasoline.

Hydrocarbon fraction is a fraction of gasoline boiling range (initial boiling point is not rated, end boiling point is not higher than 215° C.). In particular, the end boiling point may be 200° C., 180° C., 160° C. or 85° C. Preferably, the end boiling point shall not exceed 180° C. For example, the initial boiling point may reach 62° C., 85° C., 140° C. It is preferable that the initial boiling point shall not be lower than 62° C.

Oxygenate is an aliphatic alcohol or ester. It may originate from the group including: methanol, raw methanol, technical methanol, ethanol, dimethyl ether, other aliphatic alcohols, other esters, as well as their mixtures, including mixtures with water. It may contain impurities such as aldehydes, carboxylic acids, compound esters, aromatic alcohols. This method does not suggest use of unsaturated alcohols, such as allyl alcohol, but they may be present as impurities.

Olefin-containing fraction is a fraction including 10-50 wt % of olefins $C_2$-$C_4$ (ethylene, propylene, normal butylenes, isobutylene).

The olefin-containing fraction may contain inert or weakly reactive components other than olefins, e.g., methane, ethane, propane, butane, hydrogen, nitrogen. For example, the olefin-containing fraction may contain 0.5 to 8 wt % of hydrogen, preferably 2.3 to 8.0 wt % of hydrogen. Preferable mass fraction of $C_{5+}$ hydrocarbons in the olefin-containing fraction is not more than 5.0 wt %. Preferable volume fraction of hydrogen sulfide in the olefin-containing fraction is not more than 0.005%.

Reaction zone is a separate volume in a catalyst containing reactor. One reactor may accommodate several consecutive reaction zones. For example, reaction zones may be represented by the decks in a deck-type reactor. Each reaction zone may also be located in a separate reactor. Separate reactor may function as a reaction zone.

RON—octane number determined by the research method. It may be determined, for example, according to ASTM D2699 or GOST 8226.

$C_n$—hydrocarbons with n carbon atoms.

$C_{n+}$—hydrocarbons with carbon atoms number equal to or greater than n.

REE—rare-earth elements.

DME—dimethyl ether.

DGCC—dry gas of catalytic cracking.

AHF—aromatic hydrocarbon fraction.

Weight hourly space velocity, $h^{-}$—the amount of feed passed through the catalyst mass unit per time unit. For example, mass feed rate of the $i^{th}$ component:

$$WHSV_i = \frac{f_i^{inlet}}{m_{cat}}, \tag{1}$$

where $f_i^{inlet}$—mass flow rate of the $i^{th}$ component at the inlet, g/h;

$m_{cat}$—catalyst mass, g.

Conversion is a ratio of the reacted feed amount to the amount of feed supplied to reaction. For example, the $i^{th}$ component conversion:

$$x_i = \frac{f_i^{inlet} - f_i^{outlet}}{f_i^{inlet}} \cdot 100\%, \tag{2}$$

where $f_i^{inlet}$—mass flow rate of the $i^{th}$ component at the inlet, g/h;

$f_i^{outlet}$—mass flow rate of the $i^{th}$ component at the outlet, g/h.

Selectivity is a ratio of the target component amount to the total amount of hydrocarbons obtained in the process. For example, selectivity of the $i^{th}$ component of the product:

$$s_i = \frac{f_i^{outlet}}{\sum_i f_i^{outlet}} \cdot 100\%, \tag{3}$$

where $f_i^{outlet}$—mass flow rate of the $i^{th}$ component at the outlet, g/h;

$\Sigma_i f_i^{outlet}$—total mass flow of all hydrocarbons produced, g/h.

Percentage of oxygenate substitution by olefin-containing fraction (substitution %) is calculated as follows:

$$\text{substitution}\,\% = \left(1 - \frac{\sum_i k_i \cdot n_{i\,oxygenate}}{\sum_i k_i \cdot n_{i\,oxygenate} + \sum_j n_{j\,olefin}}\right) \cdot 100\%, \tag{4}$$

where $n_{i\ oxygenate}$—molar flow of the $i^{th}$ oxygenate supplied, mol/h;

$k_i$—index corresponding to the $i^{th}$ oxygenate supplied. The $k_i$ index is 0.5 for methanol, 1 for other oxygenates (e.g., ethanol, propanol, DME);

$n_{j\ olefin}$—molar flow of the $j^{th}$ olefin supplied, mol/h.

For example, when methanol must be substituted with ethylene-containing dry gas of catalytic cracking, the substitution percentage shall be calculated as follows:

$$\text{substitution}\,\% = \left(1 - \frac{0.5 \cdot n_{methanol}}{0.5 \cdot n_{methanol} + n_{ethylene}}\right) \cdot 100\%, \quad (5)$$

where $n_{methanol,\ mol/h}$—is molar flow of the methanol supplied, mol/h;

$n_{ethylene,\ mol/h}$—molar flow of ethylene supplied, mol/h;

0.5—index corresponding to methanol.

Similarly, if ethanol is used as oxygenate and the olefin-containing fraction contains ethylene, propylene and butylenes, the substitution percentage shall be calculated as follows.

$$\text{substitution}\,\% = \left(1 - \frac{1 \cdot n_{ethanol}}{1 \cdot n_{ethanol} + n_{ethylene} + n_{propylene} + n_{butylenes}}\right) \cdot 100\%, \quad (6)$$

where $n_{ethanol}$—is molar flow of the methanol supplied, mol/h;

$n_{ethylene}$—molar flow of ethylene supplied, mol/h;

$n_{propylene}$—molar flow of propylene supplied, mol/h;

$n_{butylenes}$—total molar flow of butylenes supplied (including isobutylene), mol/h;

1—index for ethanol.

Technology Level

There are several known examples of hydrocarbon fractions, oxygenates and olefin-containing fractions co-processing into gasoline or aromatic compound concentrates.

Patent RU 2671568 dated Sep. 27, 2016 refers to integrated unit for processing $C_1$-$C_{10}$ hydrocarbons mixture of different composition (low-octane gasoline fractions of IBP-180° C., 90-160° C. or narrower fractions, pentane-heptane (or hexane) fractions, propane-butane fractions, natural gas liquids (NGL) and/or $C_2$-$C_{10}$ olefins and/or their mixtures with each other, and/or with $C_1$-$C_{10}$ paraffins, and/or with hydrogen) in presence of oxygen-containing compounds, including one or more parallel sectioned adiabatic reactors consisting of one or more stationary zeolite-containing catalyst layers (sections) with heat input or output between the catalyst layers (sections). The proposed unit allows to obtain high-octane gasoline, diesel fractions or aromatic hydrocarbons.

The invention weak point is the need to add substantial amounts of isobutane to the feedstock in order to control the temperature in the reaction zones. Isobutane is a demanded high-value product of oil refinery operations. Its redirection to the hydrocarbon fraction processing will lead to increased costs of gasoline or aromatic hydrocarbon concentrate production.

Another weak point of the invention is the partial gaseous product circulation directly through the catalyst layer. Recycling of the gaseous product makes the necessary equipment and its maintenance more complicated. Besides, this approach does not allow handling sulfur-containing feedstock without involving additional treatment methods. Specifically, the plant incorporates a sulfur compounds removal unit with the use of hydrogen-containing gas obtained in the process from at least part of the hydrocarbon feed. Incomplete feedstock desulfurization can lead to production of gaseous product contaminated with sulfur compounds. Recycling of such gaseous product will lead to accelerated catalyst poisoning with sulfur-containing gas compounds (hydrogen sulfide, mercaptans).

The invention application WO2017155431 (PCT/RU2017/050009) describes the method to obtain gasoline from crude hydrocarbon fractions, olefin gaseous fractions and oxygenates. They use a reactor containing at least two reaction zones with zeolite-containing catalyst with a device additionally located between them for mixing the reaction products of previous reaction zone and supplied methanol or other oxygenates and olefin-containing feedstock, and the stream supply unit delivers:

- A stream of methanol or other oxygenates and olefin-containing feedstock and a stream of crude hydrocarbon fractions to the reactor's first reaction zone,
- A stream of methanol or other oxygenates and olefin-containing feedstock to the reactor's second reaction zone.

The fact that the end catalyst layer temperature is 40-70° C. lower than the maximum temperature of the catalyst layer during gasoline production may be considered as the weak point of this method. Such temperature drop in the end catalyst layer may lead to uneven catalyst coking and to side reactions (e.g., olefins oligomerization instead of their involvement in aromatics alkylation and aromatics formation processes).

The necessity of additional heat supply to the reaction zones at low methanol flow rates (less than 20% of convertible feed weight), also due to further overheating of the feed stream supplied to the final and/or next-to-final reaction zones (up to 500° C. maximum) or due to use of isothermal reaction zones as one or two final reaction zones of the reactor, may also be considered as a weak point of this method.

This method is taken as a prototype as most relevant to the present invention.

However, none of the described documents investigates the ways the feedstock distribution between the reaction zones affects the process parameters. The problems arising in process of pure olefins substitution with cheap sources of $C_2$-$C_4$ olefins are not taken into account. Conditions that allow to obtain a high-octane product when the feedstock includes methane, ethane, hydrogen, and nitrogen are not disclosed. Besides, no insight is provided as to use of a specific-composition feedstock with appropriate distribution between the reaction zones that will allow to avoid the gaseous products recycling.

Invention Disclosure

This invention is expected to provide the following technical effects:

1. Reducing oxygenates consumption by means of partially replacing oxygenate with olefin-containing fractions;
2. Possibility to use the low-demand hydrocarbon fractions with high content of hydrocarbons $C_6$ and isoparaffins $C_7$ as a feedstock;
3. Involvement of olefin-containing fractions including hydrogen without its additional separation into production of high-octane products;
4. Possibility to use as feedstock the olefin-containing fractions with olefin content less than 50 wt % without preliminary concentration of olefins;
5. Absence of oxygenates in the liquid hydrocarbon product;
6. Possibility to avoid gaseous products recycling;
7. Reduction of benzene content in the product;
8. Enhancement of n-hexane and n-heptane conversion;
9. Reduction of naphthalenes and alkylnaphthalenes content in $C_{5+}$ fraction of the product;
10. Possibility to produce low-benzene aromatics concentrates;

11. Possibility to produce aromatics concentrate with high $C_8$ alkylbenzenes content.

Objective of the invention is to reduce oxygenates consumption during co-processing of hydrocarbon fractions and oxygenates into gasoline or aromatic compound concentrates while maintaining yield and quality of the product. The problem is expected to be solved, specifically, by partial replacement of oxygenates with low-value olefin-containing fractions.

The proposed method is also expected to solve the problem of low-demand hydrocarbon fractions processing into gasoline or aromatic compound concentrates. These are hydrocarbon fractions, which may not serve as a preferred feedstock for catalytic reforming or classical isomerization because of high content of $C_6$ hydrocarbons and $C_7$ isoparaffins. In particular, the proposed method allows to use hydrocarbon fractions with more than 36 wt % of $C_6$ hydrocarbons and more than 26 wt % of $C_7$ isoparaffins. At the same time, in gasoline production, it is possible to achieve benzene content in $C_{5+}$ fraction of produced gasoline of less than 2 wt %, yield over 70% and the product RON of at least 90.

The proposed method may also be applied to hydrocarbon fractions without content limitation of $C_6$ hydrocarbons and/or $C_7$ isoparaffins. Low content of such components in gasoline production makes it possible to achieve yields of more than 80% per hydrocarbon fraction supplied and to reach benzene content of less than 1 wt % in the product.

The proposed invention also makes it possible to use such low-margin stream as dry gas of catalytic cracking (DGCC) as an olefin-containing fraction. DGCC and other streams with relatively low olefin content often contain hydrogen. The content of both olefins and hydrogen in such streams is too low for commercial separation. Therefore, gases like DGCC are often used as fuel gases. The proposed method allows to use such low-margin olefin-containing fractions in gasoline production. Besides, the proposed method allows to avoid the necessity to pre-separate hydrogen from used olefin-containing fractions, specifically, with hydrogen content up to 8 wt %. At the same time, the proposed method does not require preliminary concentration of olefins in used olefin-containing fractions with olefin content below 50 wt %. In particular, olefin-containing fractions with olefins content above 10 wt % can be supplied to the reaction zones without preliminary actions to increase olefin concentration in the feed stream.

$C_2$-$C_4$ olefins conversion in the proposed method reaches 98-100 wt %, which makes recycling of gaseous product for the olefins re-processing unnecessary.

The problems are solved and above mentioned technical effects are achieved by the proposed method of producing liquid hydrocarbon product containing aromatic compounds, wherein three streams are used as feedstock, the first of these includes a hydrocarbon fraction, the second stream includes oxygenate, and the third one includes an olefin-containing fraction, where:

a. The olefin-containing fraction includes one or more olefins from the group including ethylene, propylene, normal butylenes, isobutylene, in total amount from 10 to 50 wt %,
b. Three reaction zones filled with zeolite catalyst are used,
c. The first stream is fed to at least one reaction zone,
d. The second stream is fed to the first reaction zone,
e. The third stream is distributed between three reaction zones, with the mass fraction of the third stream distributed to the final reaction zone being higher than the mass fraction of the third stream distributed to each of the previous reaction zones,
f. Provided that the product stream from the first reaction zone is supplied to the second reaction zone, and the product stream from the second reaction zone is supplied to the third reaction zone.

It is possible to implement the invention in the option where the liquid hydrocarbon product containing aromatic compounds is represented by gasoline, if aromatic compound content is less than 46 wt %, or the liquid hydrocarbon product containing aromatic compounds is represented by aromatics concentrate, if aromatic compound content is higher than 46 wt %.

It is possible to implement the invention in the option where the first stream is preferably supplied to the first reaction zone.

It is possible to implement the invention in the option where the third stream distribution between the three reaction zones is 10-30 wt %/20-35 wt %/40-70 wt %.

It is possible to implement the invention in the option where the hydrocarbon fraction contains normal paraffins in the amount of 15-24 wt %, isoparaffins in the amount of 28-56 wt %, naphthenes in the amount of 22-40 wt %, the rest are aromatic hydrocarbons and olefins.

It is possible to implement the invention in the option where the hydrocarbon fraction contains 0 to 80 wt % of $C_6$ hydrocarbons, preferably 23 to 46 wt % of $C_6$ hydrocarbons, most preferably 36 to 46 wt % of $C_6$ hydrocarbons.

It is possible to implement the invention in the option where the hydrocarbon fraction contains 0 to 70 wt % of $C_7$ isoparaffins, preferably 26 to 50 wt % of $C_7$ isoparaffins, most preferably 26 to 38 wt % of $C_7$ isoparaffins.

It is possible to implement the invention in the option where the hydrocarbon fraction may be selected from the group including straight-run gasoline, stable natural gasoline, light gas condensate, gasoline fraction with boiling range of about 62-85° C., raffinate, and mixtures thereof.

It is possible to implement the invention in the option where the first olefin-containing fraction has a mass fraction of $C_{5+}$ hydrocarbons from 0 to 10.0 wt %, preferably from 0 to 5.0 wt %.

It is possible to implement the invention in the option where the olefin-containing fraction may include $C_{5+}$ olefins, such as pentenes, hexenes.

It is possible to implement the invention in the option where the olefin-containing fraction has a volume fraction of hydrogen sulfide from 0.0 to 0.005%.

It is possible to implement the invention in the option where the olefin-containing fraction can include hydrocarbon components other than olefins, such as methane, ethane, propane, butane, and can contain inorganic gases, such as hydrogen, nitrogen.

It is possible to implement the invention in the option where the olefin-containing fraction comprises 0.5-8.0 wt % of hydrogen, preferably 2.3-8.0 wt % of hydrogen.

It is possible to implement the invention in the option where the olefin-containing fraction may include $C_{5+}$ olefins, such as pentenes, hexenes.

It is possible to implement the invention in the option where the olefin-containing fraction is selected from the group including dry gas of catalytic cracking, wet gas of catalytic cracking, other catalytic cracking gases and their fractionation products, waste gas from the coker unit, Fischer-Tropsch synthesis gases, and mixtures thereof.

It is possible to implement the invention in the option where the olefin-containing fraction is selected from the group including propane-propylene fractions, butane-butylene fractions, thermal cracking gas, visbreaking gas, hydrocracking exhaust gases, pyrolysis gas, catalytic reforming waste gas, and mixtures thereof.

It is possible to implement the invention in the option where the olefin-containing fraction comprises dry gas of catalytic cracking and contains from 25 to 40 wt % of $C_2$-$C_4$ olefins.

It is possible to implement the invention in the option where the oxygenate is selected from the group including aliphatic alcohols, such as methanol, ethanol, crude methanol, technical methanol, ethanol; simple esters, e.g., dimethyl ether; and mixtures thereof, including mixtures with water.

It is possible to implement the invention in the option where the oxygenate may contain impurities, such as aldehydes, carboxylic acids, compound ethers.

It is possible to implement the invention in the option where the process pressure is from 1.5 to 4.0 MPa, preferably from 2.2 to 2.7 MPa.

It is possible to implement the invention in the option where the weight hourly space velocity is 0.5-10 $h^{-1}$, preferably 1-3 $h^{-1}$.

It is possible to implement the invention in the option where the stream temperature at the inlet to the first/second/third reaction zones is 340-450° C./340-450° C./340-450° C.

It is possible to implement the invention in the option where the weight hourly space velocity is 0.5-10 $h^{-1}$, preferably 1-3 $h^{-1}$.

It is possible to implement the invention in the option where the stream temperature at the inlet to the first/second/third reaction zones is 340-370° C./340-370° C./340-370° C.

It is possible to implement the invention in the option where the weight hourly space velocity is 0.9-10 $h^{-1}$, preferably 1-3 $h^{-1}$.

It is possible to implement the invention in the option where the stream temperature at the inlet to the first/second/third reaction zones is 390-450° C./390-450° C./390-450° C.

It is possible to implement the invention in the option where the weight hourly space velocity is 0.1-0.9 $h^{-1}$.

It is possible to implement the invention in the option where the catalyst distribution between the reaction zones is 15-25 wt %/30-33 wt %/35-50 wt % of the total catalyst amount for the first/second/third reaction zones, respectively.

It is possible to implement the invention in the option where the distributed catalyst mass for each subsequent reaction zone is higher than the distributed catalyst mass per each previous reaction zone.

It is possible to implement the invention in the option where the hydrocarbon fraction is 38-79 wt % of the supplied feed.

It is possible to implement the invention in the option where the olefin-containing fraction is 13-57 wt % of the supplied feed.

It is possible to implement the invention in the option where the oxygenate is 3.8-8.0 wt % of the supplied feed.

It is possible to implement the invention in the option where the zeolite catalyst includes:

a. ZSM-5 type zeolite with modulus $SiO_2/Al_2O_3$ from 43 to 95, in the amount of 65 to 80 wt %;
b. Sodium oxide in the amount of 0.04 to 0.15 wt %;
c. Zinc oxide in the amount of 1.0 to 5.5 wt %;
d. Oxides of rare earth elements in total amount of 0.5 to 5.0 wt %;
e. Binder comprising silicon dioxide, aluminum oxide or mixtures thereof.

It is possible to implement the invention in the option where the zeolite catalyst is free of platinum metals.

It is possible to implement the invention in the option where the rare earth elements are selected from the group including lanthanum, praseodymium, neodymium, cerium, as well as mixtures thereof.

It is possible to implement the invention in the option where the reaction takes place in the gas phase in static catalyst layer.

Implementation of the Invention

To carry out the process, the hydrocarbon fraction, oxygenate and olefin-containing fraction are separated into several streams. The streams are fed to the reaction zones:

$R_{101}$—first reaction zone;
$R_{201}$—second reaction zone;
$R_{301}$—third reaction zone.

Hydrocarbon fraction is supplied to at least one reaction zone. For this purpose, the hydrocarbon fraction can be divided into one, two or three streams. Specifically, to run the experiments according to examples 1-11, the whole hydrocarbon fraction was delivered to the first reaction zone (i.e. no second and third hydrocarbon fraction streams were created). To run the experiment according to example 12, the hydrocarbon fraction was distributed into three reaction zones (i.e. the first, second and third hydrocarbon fraction streams were created).

It is also possible to distribute the whole hydrocarbon fraction stream only to the second or only to the third reaction zone, if necessary. In other option, the proposed process allows to distribute the hydrocarbon fraction between several reaction zones.

Oxygenate is supplied to the first reaction zone.

Olefin-containing fraction is supplied to three reaction zones. For this purpose, the olefin-containing fraction stream is divided into three streams. In this case, portion of the olefin-containing fraction stream coming to the third reaction zone is higher than portion of the olefin-containing fraction stream coming to any of the previous reaction zones.

When implementing the method, the product stream from the first reaction zone is supplied to the second reaction zone, and the product stream from the second reaction zone is supplied to the third reaction zone.

In this case, each of the streams supplied to a particular reaction zone may be heated before or after mixing with other streams.

The feed streams supplied to a particular reaction zone are mixed in the mixing area upstream of catalyst layer of the given reaction zone. The mixing area of the reaction zone may be represented, for instance, by:

Layer of neutral material pellets placed before the zeolite catalyst layer, e.g., a protective layer, preliminary catalytic purifier;
Connecting line (pipeline) that connects the reaction zones;
Heater (or preheater) located between the reaction zones.

The product stream from the third reaction zone is divided into hydrocarbon fraction of the product and water fraction of the product. The product water fraction is diverted.

The product hydrocarbon fraction is further divided into liquid hydrocarbon product and gaseous product by means of fractionation and stabilization methods. Specifically, processes of settling and degassing of the water phase, debutanization of the hydrocarbon phase, propane condensation, etc. can take place. The gaseous product can be additionally divided into gaseous product fraction enriched with $C_3$-$C_4$ hydrocarbons and gaseous product fraction enriched with $C_1$-$C_2$ hydrocarbons.

Main component of the liquid hydrocarbon product is $C_{5+}$ hydrocarbons (hydrocarbons with five or more carbon atoms). Depending on the particular production objectives, the liquid hydrocarbon product may contain not only $C_{5+}$ hydrocarbons, but also various amounts of dissolved $C_1$-$C_4$ gases. In particular, in process of production of motor gasoline, it is usually permitted to have up to 3-5 wt % of dissolved gases in summer gasoline and up to 5-7 wt % of dissolved gases in winter gasoline. The gaseous product may include $C_1$-$C_4$ hydrocarbons, nitrogen, hydrogen and other inorganic gases, as well as heavier hydrocarbons.

Product streams can be routed to external heat exchangers, such as waste heat exchangers, for feedstock streams heating and product streams pre-cooling.

EXAMPLES

The results achieved are demonstrated below in examples 1-12.

Examples 1-6, 12 and comparative example 7 demonstrate the gasoline production case. Examples 8-11 show the possibility of obtaining aromatic compound concentrates.

The proposed process allows to produce liquid hydrocarbon product which can be used as gasoline or aromatic compound concentrate.

Gasoline and aromatic compound concentrate differ in total aromatics content in the product. Some states and companies limit the maximum total aromatics content in commercial gasoline to 35 vol. % (approximately 38-40 wt % of aromatics). Specific environmental regulations allow up to 40-46 wt % of aromatics in commercial motor gasoline. In this regard, the liquid hydrocarbon product with total content of aromatics below 46 wt % refers to gasoline. In particular, the proposed method allows producing liquid hydrocarbon product, which can be sold as commercial motor gasoline without additional compounding. Liquid hydrocarbon product with total content of aromatic hydrocarbons above 46 wt % refers to aromatic compound concentrates. In particular, the proposed method allows producing liquid hydrocarbon product, which can be used as high-octane aromatics concentrate to be used as the main component in motor gasoline compounding.

It should be noted that depending on the state or enterprise, the maximum allowable concentration of aromatics in commercial gasoline may differ from 38-46 wt %.

Concentration of aromatics in obtained liquid hydrocarbon product can be controlled by means of several parameters. Specifically, an increase in supplied feed temperature and/or decrease in supplied feed mass rate results in increase in aromatics mass fraction in the obtained liquid hydrocarbon product.

Examples 8-11 demonstrate production of aromatic compound concentrates with more than 46 wt % of aromatics at temperatures of 390-450° C. and/or at weight hourly space velocity from 0.1 to 0.9 Such aromatics concentrates may be used as the main component in compounding (blending) of commercial gasolines. It is also possible to use aromatic compound concentrates for further processing by petrochemical methods.

Comparative example 7 differs from the invention examples by the fact that no olefin-containing fraction is supplied to the reaction zones. Hence, oxygenate consumption for the process is not reduced due to partial oxygenate substitution with olefin-containing fractions (i.e. substitution of oxygenate with olefin-containing fractions is 0%). The proposed invention examples 1-6, 12 and 8-11 illustrate that it is possible to partially substitute oxygenates with olefin-containing gases while maintaining the yield, product quality and feedstock processing depth.

In examples 1-12, the yield and other process parameters are shown for liquid hydrocarbon product not containing dissolved $C_1$-$C_4$ gases ($C_{5+}$ hydrocarbon fraction of the product). This is related to the fact that liquid hydrocarbon products obtained and stored under different conditions may contain different amounts of dissolved gases. At the same time, the dissolved gases content may change unevenly over time, changing the chemical composition. This can lead to inadequate comparison of the yield and the product quality in different experiments, especially when comparing results of different refineries. Therefore, it is preferable to compare the parameters of the product free of dissolved gases. However, it should be noted that depending on the specific production objectives, the liquid hydrocarbon product may contain not only $C_{5+}$ hydrocarbons, but also various amounts of dissolved $C_1$-$C_4$ gases.

Whereas $C_{5+}$ hydrocarbons (hydrocarbons with five or more carbon atoms) are the main component of liquid hydrocarbon product, the yield of the liquid hydrocarbon product will increase simultaneously with the yield of $C_{5+}$ hydrocarbons.

In examples 1-11, a catalytic unit including three reactors connected in series with total catalyst loading of up to 9 liters are used. The reactors are designated as the first, second and third reaction zones, $R_{101}$, $R_{201}$, $R_{301}$, respectively.

In terms of the structure, reactors are mostly of adiabatic type, heat exchange between catalyst layer and vessel is minimized. Catalyst baskets are placed in the reactor vessel so that a gap (about 2 mm) is left between the basket wall and the solid vessel. Each reactor is installed heating elements with thermostats with three heating zones. Three thermocouples are placed between surfaces of the heating elements and outside surface of the reactor vessel. Opposite them, thermocouples are also placed on the inside wall of the reactor basket. There is also an air gap between the thermostat inside surface and the reactor outside surface, not exceeding 3-4 mm. Constant temperature difference between thermocouples at the reactor outside wall and opposite thermocouple at the reactor basket inside surface is maintained by control circuits.

They started to sample the liquid and gaseous products for test 4 hours after the start of the feed supply.

Table 1 shows the chemical composition of hydrocarbon fractions used in examples 1-12. Specifically, 62-85° C. fraction (fr. 62-85° C.) represents benzene-forming portion of the catalytic reforming feedstock (approximate boiling range: 62-85° C.). Raffinate is normally a mixture of mainly gasoline-range hydrocarbons that are a by-product gasoline fraction selected from an aromatic hydrocarbon extraction unit. For instance, the raffinate may be an extraction by-product of the benzene-toluene fraction. The raffinate may also be an extraction istillation by-product of the toluene-xylene fraction.

Table 2 shows the composition of olefin-containing fractions used in examples 1-12. The used olefin-containing fractions can be considered, specifically, as a model of dry gas of catalytic cracking sample (DGCC compositions are obtained as a result of refinery's data averaging over several months of catalytic cracking unit operation). However, it should be noted that olefin-containing fractions nomination and origin process may vary depending on refinery and region. Attention should be paid to chemical composition of the fraction used, specifically, the olefin-containing fraction should include $C_2$-$C_4$ olefins in total amounts of 10 to 50 wt %. Preferable mass fraction of $C_{5+}$ hydrocarbons in the olefin-containing fraction is not more than 5.0 wt %. Preferable volume fraction of hydrogen sulfide in the olefin-containing fraction is not more than 0.005%. The olefin-containing fraction may contain hydrogen in concentration from 0.5 to 8 wt %, preferably from 2.3 to 8 wt % of hydrogen.

Methanol of technical grade "A" as per GOST 2222-95 is used as oxygenate in examples 1-3, 6-8 and 11-12. Examples 4 and 10 use dimethyl ether (DME), 99%. Examples 5 and 9 use 95% ethanol.

Table 3 shows the composition of zeolite catalysts used in examples 1-12.

Table 4 shows the conditions and main parameters of examples 1-7. The hydrocarbon fraction in examples 1-7 is supplied to the first reaction zone. Example 12 repeats conditions of example 1, with the exception that hydrocarbon fraction in example 12 is distributed over three reaction zones in the ratio of 50/25/25 wt %. Experiments with the invention were run at pressures of 15-40 bar (1.5-4.0 MPa), preferably 22-27 bar (2.2-2.7 MPa). The oxygenate substitution % parameter (percentage of oxygenate substitution with olefin-containing fractions) is calculated according to formulas (4) to (6) of this Description.

Table 5 and Table 7 show the composition of liquid hydrocarbon product in examples 1-7.

Example 12 shows the yield of $C_{5+}$ liquid hydrocarbon product of 77.7 wt % per hydrocarbon fraction supplied with product RON of 90.8 and aromatics content of 29.6 wt % (the data are provided for liquid hydrocarbon product free of dissolved gases).

Table 7 shows gasoline composition after separation of gaseous products from it, with dissolved gases content in gasoline stabilized at 3-5 wt % (stabilized liquid hydrocarbon product). Such product can be considered as a stable gasoline or high-octane base for production of commercial gasoline. The products in Table 8 contain from 3 to 5 wt % of dissolved $C_1$-$C_4$ gases. However, depending on the particular production objectives, the liquid hydrocarbon product may contain various amounts of dissolved $C_1$-$C_4$ gases. In particular, in process of production of motor gasoline, it is usually permitted to have up to 3-5 wt % of dissolved gases in summer gasoline and up to 5-7 wt % of dissolved gases in winter gasoline. The desired amount of dissolved gases in the product is controlled by standard fractionation and stabilization methods.

Table 5 shows the product compositions for the same experiments as referred to in Table 7, but Table 5 shows the composition of liquid hydrocarbon products free of dissolved $C_1$-$C_4$ gases ($C_{5+}$ hydrocarbon fraction of the product). Normally, the refineries do not need to obtain a product free of dissolved gases. However, the yield and composition comparison of $C_{5+}$ products are more indicative. Liquid hydrocarbon products obtained and stored under different conditions may contain different amounts of dissolved gases. At the same time, the dissolved gases content may change unevenly over time, changing the chemical composition. This can lead to inadequate comparison of the yield and the product quality in different experiments, especially when comparing results of different refineries. Therefore, it is preferable to compare the parameters of the product free of dissolved gases. However, it should be noted that depending on the particular production objectives, the liquid hydrocarbon product may contain not only $C_{5+}$ hydrocarbons, but also various amounts of dissolved $C_1$-$C_4$ gases, specifically, as shown in Table 7.

Whereas $C_{5+}$ hydrocarbons (hydrocarbons with five or more carbon atoms) are the main component of liquid hydrocarbon product, the yield of the liquid hydrocarbon product will increase simultaneously with the yield of $C_{5+}$ hydrocarbons.

Table 6 shows the conditions and main parameters of examples 8-11. Hydrocarbon fraction in examples 8-11 is supplied to the first reaction zone. The experiments were run at pressures of 22-27 bar (2.2-2.7 MPa).

Gaseous product in examples 1-12 included mainly hydrocarbons and nitrogen. The nitrogen source is the olefin-containing fractions supplied to the reaction. In the invention examples, the gaseous product content of $C_{3+}$ hydrocarbons (mainly propane) was 37-61 vol. %. Total olefins content in the gaseous product was 0.7-1.4 vol. %, proving the degree of feed olefins conversion. The ethane content was 0.3-1.2 vol. %, indicating suppression of side processes of ethylene hydrogenation by feedstock hydrogen.

TABLE 1

| Composition of hydrocarbon fractions, wt % | | | | | |
|---|---|---|---|---|---|
| | Hydrocarbon fraction, # | | | | |
| | A | B | C | D | E |
| | Description | | | | |
| | Mixture: 50 vol. % raffinate and 50 vol. % fr. 62-85 | Stable natural gasoline | Light gas condensate | Straight-run fraction 65° C. - e.b.p.** | Straight-run fraction 85-180° C.*** |
| General hydrocarbon composition, PIONA*, wt % | | | | | |
| P (n-paraffins) | 24.3 | 16.4 | 15.6 | 19.1 | 20.2 |
| I (isoparaffins) | 41.7 | 47.0 | 42.4 | 55.7 | 27.6 |
| O (olefins) | 1.8 | 1.1 | 1.1 | 1.6 | 1.7 |
| N (naphthenes) | 30.7 | 34.1 | 39.8 | 22.0 | 39.0 |
| A (aromatics) | 1.5 | 0.9 | 1.1 | 0.7 | 11.2 |
| Unidentified | — | 0.5 | 0.0 | 0.9 | 0.3 |
| Total, wt % | 100.0 | 100.0 | 100.0 | 100.0 | 100.0 |
| Detailed hydrocarbon composition, wt % | | | | | |
| $C_1$-$C_4$ hydrocarbons | 0.0 | 0.0 | 0.0 | 0.0 | 0.1 |
| n-pentane | 1.1 | 0.2 | 0.3 | 0.4 | 0.0 |
| n-hexane | 14.7 | 6.6 | 8.0 | 4.3 | 0.0 |
| n-heptane | 6.8 | 7.3 | 5.7 | 10.7 | 7.6 |
| Normal $C_{8+}$ paraffins | 1.7 | 2.3 | 1.6 | 3.7 | 12.5 |
| Isopentane | 0.4 | 0.0 | 0.0 | 0.1 | 0.0 |
| $C_6$ isoparaffins | 7.4 | 2.3 | 2.0 | 3.5 | 0.0 |
| $C_7$ isoparaffins | 26.3 | 36.0 | 34.5 | 37.8 | 5.6 |
| $C_{8+}$ isoparaffins | 7.6 | 8.7 | 5.9 | 14.3 | 22.0 |
| $C_{5+}$ olefins | 1.8 | 1.1 | 1.1 | 1.6 | 1.7 |
| Cyclopentanes | 17.1 | 17.6 | 20.0 | 12.6 | 11.1 |
| Cyclohexanes | 13.6 | 16.5 | 19.8 | 9.4 | 27.9 |
| Aromatics | 1.5 | 0.9 | 1.1 | 0.7 | 11.2 |
| Unidentified | — | 0.5 | 0.0 | 0.9 | 0.3 |
| Total, wt % | 100.0 | 100.0 | 100.0 | 100.0 | 100.0 |
| incl. $C_6$ hydrocarbons | 46.1 | 36.4 | 43.4 | 23.4 | 1.2 |
| incl. benzene | 1.2 | 0.7 | 0.9 | 0.4 | 0.0 |

*P (normal paraffins), I (isoparaffins), O (olefins), N (naphthenes), A (aromatics). Index is used for quick assessment of the fraction composition.

**Straight-run gasoline, e.b.p.-nd boiling point is not determined.

***Catalytic reforming feedstock. Characterized by low content of benzene-forming fraction ($C_6$ hydrocarbons) and low content of $C_7$ isoparaffins.

TABLE 2

| Composition of olefin-containing fractions, wt % | | | | |
|---|---|---|---|---|
| Olefin containing fraction, wt % | A | B | C | D |
| Methane | 0.0 | 4.8 | 38.5 | 21.7 |
| Ethane | 0.0 | 18.8 | 20.2 | 18.6 |
| Ethylene | 33.8 | 31.4 | 8.8 | 18.2 |
| Propane | 0.0 | 2.3 | 0.8 | 0.7 |
| Propylene | 0.0 | 13.5 | 0.7 | 3.5 |
| Isobutane | 0.0 | 3.5 | 0.8 | 0.7 |
| n-butane | 0.0 | 0.7 | 0.4 | 0.5 |
| Sum of butylenes (butene-1, butene-2, isobutylene, butadiene) | 0.0 | 5.1 | 0.5 | 2.3 |
| Sum of $C_{5+}$ hydrocarbons | 0.0 | 4.2 | 0.2 | 3.0 |
| $H_2$ | 2.3 | 0.0 | 8.0 | 0.5 |
| $N_2$ | 63.9 | 15.0 | 19.5 | 28.2 |
| Unidentified | 0.0 | 0.7 | 1.6 | 2.1 |
| Total: | 100.0 | 100.0 | 100.0 | 100.0 |
| incl. olefins | 33.8 | 50.0 | 10.0 | 24.0 |
| incl. $C_1$-$C_2$ hydrocarbons | 33.8 | 55.0 | 67.5 | 58.5 |

TABLE 3

| Composition of zeolite catalysts used in examples 1-12 | | | | |
|---|---|---|---|---|
| Parameter | Standard | A | B | C |
| Zeolite type | — | ZSM-5 | ZSM-5 | ZSM-5 |
| Zeolite module, $SiO_2$/$Al_2O_3$ mole ratio | 43-95 | 77 | 43 | 95 |
| Composition of zeolite catalysts, wt % | | | | |
| High silica zeolite of pentasyl family | not less than 65.0 | 70 | 65 | 80 |
| Sodium oxide | not more than 0.15 | 0.08 | 0.15 | 0.04 |
| Zinc oxide | 1.0-5.5 | 2.0 | 1.0 | 5.5 |
| Sum of oxides of rare earth elements* | 0.5-5.0 | 1.6 | 5.0 | 0.5 |
| Binder ($SiO_2$ and/or $Al_2O_3$) | Other, up to 100% | Other, up to 100% | Other, up to 100% | Other, up to 100% |
| including mass fraction of silicon dioxide expressed as catalyst calcined at 550° C. | 55.0-80.0 | 69 | 55 | 80 |

*Rare earth elements (REE) include, specifically, lanthanum, praseodymium, neodymium, cerium, preferably their mixtures. Individual compounds of each element, such as nitrates, can be used as a source of rare earth element compounds. Mixtures of rare earth element compounds can also be a source of rare earth compounds. Specifically, semi-finished products of rare earth element production with mixed REE compounds content of at least 60 wt %, such as rare earth elements concentrate, rough REE concentrate, collective concentrates of rare earth metals, semi-finished products of rare earth ores processing, can be used as a source of rare earth element compounds. Mixtures of rare earth elements compounds can be used without preliminary separation of individual rare earth elements compounds.

TABLE 4

| Conditions and main parameters in examples 1-7 | | | | | | | |
|---|---|---|---|---|---|---|---|
| | Experiment number | | | | | | |
| | 1 | 2 | 3 | 4 | 5 | 6 | 7 (comparative) |
| Hydrocarbon fraction | B | B | C | A | D | E | B |
| Oxygenate | methanol | methanol | methanol | DME | ethanol | methanol | methanol |
| Olefin-containing fraction | A | B | B | D | C | A | A |
| Catalyst | A | A | B | B | C | A | A |
| Weight hourly space velocity, $h^{-1}$ | 1.7 | 1.6 | 1.7 | 1.5 | 3.1 | 1.7 | 1.7 |
| Total catalyst weight, grams | 4713 | 4357 | 4357 | 4470 | 4316 | 4713 | 4713 |
| Pressure, bar | 22 | 27 | 22 | 15 | 40 | 27 | 5 |
| Feed supply temperature, | 350 | 350 | 340 | 370 | 350 | 340 | 350 |
| $R_{101}$, $R_{201}$, $R_{301}$, ° C. | 350 | 350 | 350 | 370 | 350 | 340 | 350 |
| | 350 | 350 | 360 | 370 | 350 | 340 | 350 |
| Percentage of oxygenate substitution with olefin-containing fraction, % | 77.7 | 84.0 | 75.4 | 36.8 | 63.2 | 80.9 | 0.0 |
| Hydrocarbon fraction, distribution over reaction zones, wt % | | | | | | | |
| $R_{101}$* | 100 | 100 | 100 | 100 | 100 | 100 | 100 |
| $R_{201}$ | 0 | 0 | 0 | 0 | 0 | 0 | 0 |
| $R_{301}$ | 0 | 0 | 0 | 0 | 0 | 0 | 0 |
| Oxygenate, distribution over reaction zones, wt % | | | | | | | |
| $R_{101}$ | 100 | 100 | 100 | 100 | 100 | 100 | 41 |
| $R_{201}$ | 0 | 0 | 0 | 0 | 0 | 0 | 37 |
| $R_{301}$ | 0 | 0 | 0 | 0 | 0 | 0 | 22 |
| Olefin-containing fraction, distribution over reaction zones, wt % | | | | | | | |
| $R_{101}$ | 30 | 22 | 20 | 25 | 30 | 20 | none |
| $R_{201}$ | 30 | 33 | 20 | 20 | 20 | 35 | |
| $R_{301}$ | 40 | 45 | 60 | 55 | 50 | 45 | |
| Catalyst, distribution over reaction zones, wt % | | | | | | | |
| $R_{101}$ | 22 | 22 | 15 | 15 | 25 | 22 | 22 |
| $R_{201}$ | 33 | 33 | 35 | 35 | 30 | 33 | 33 |
| $R_{301}$ | 45 | 45 | 50 | 50 | 45 | 45 | 45 |

TABLE 4-continued

| Conditions and main parameters in examples 1-7 | | | | | | | |
|---|---|---|---|---|---|---|---|
| | Experiment number | | | | | | |
| | 1 | 2 | 3 | 4 | 5 | 6 | 7 (comparative) |
| Feed composition, wt % | | | | | | | |
| Hydrocarbon fraction, wt % | 70.8 | 75.9 | 69.1 | 78.9 | 37.7 | 68.8 | 73.7 |
| Oxygenate, wt % | 5.3 | 3.8 | 7.5 | 8.0 | 5.2 | 4.8 | 26.3 |
| Olefin containing fraction, wt % | 23.9 | 20.3 | 23.4 | 13.1 | 57.1 | 26.4 | 0.0 |
| Total, wt % | 100.0 | 100.0 | 100.0 | 100.0 | 100.0 | 100.0 | 100.0 |
| Main process parameters | | | | | | | |
| $C_{5+}$ fraction yield **, wt % | 74.8 | 72.6 | 73.8 | 74.1 | 74.2 | 81.4 | 71.6 |
| $C_{5+}$ product RON | 90.6 | 92.4 | 90.8 | 91.6 | 90.5 | 90.4 | 88.1 |

*$R_{101}$, $R_{201}$, $R_{301}$-first, second and third reaction zones.
** $C_{5+}$ hydrocarbon yield per hydrocarbon fraction supplied.

TABLE 5

| Composition of liquid hydrocarbon product free of dissolved gases ($C_{5+}$ product) | | | | | | | |
|---|---|---|---|---|---|---|---|
| | Example No. | | | | | | |
| | 1 | 2 | 3 | 4 | 5 | 6 | 7 (comparative) |
| General hydrocarbon composition, PIONA*, wt % | | | | | | | |
| P (n-paraffins) | 9.3 | 6.2 | 10.2 | 9.5 | 8.0 | 8.5 | 11.1 |
| I (isoparaffins) | 42.7 | 39.9 | 46.1 | 40.3 | 49.5 | 32.6 | 45.0 |
| O (olefins) | 1.2 | 0.7 | 2.1 | 3.8 | 1.9 | 5.7 | 1.3 |
| N (naphthenes) | 12.3 | 5.0 | 8.7 | 9.1 | 7.3 | 18.3 | 7.5 |
| A (aromatics) | 32.8 | 45.7 | 31.2 | 37.0 | 31.7 | 30.5 | 32.3 |
| Unidentified | 1.7 | 2.5 | 1.7 | 0.3 | 1.6 | 4.4 | 2.8 |
| Total, wt % | 100.0 | 100.0 | 100.0 | 100.0 | 100.0 | 100.0 | 100.0 |
| Detailed hydrocarbon composition, wt % | | | | | | | |
| $C_1$-$C_4$ hydrocarbons | 0.0 | 0.0 | 0.0 | 0.0 | 0.0 | 0.0 | 0.0 |
| n-pentane | 5.1 | 4.5 | 5.3 | 6.6 | 5.8 | 4.5 | 5.6 |
| n-hexane | 3.1 | 1.4 | 3.8 | 1.7 | 1.6 | 2.0 | 3.5 |
| n-heptane | 0.8 | 0.2 | 0.7 | 0.2 | 0.3 | 0.8 | 0.9 |
| Normal $C_{8+}$ paraffins | 0.3 | 0.1 | 0.4 | 1.0 | 0.3 | 1.2 | 1.1 |
| Isopentane | 6.9 | 8.8 | 6.3 | 11.1 | 9.5 | 5.1 | 6.9 |
| $C_6$ isoparaffins | 7.0 | 7.1 | 7.1 | 8.9 | 9.8 | 4.5 | 8.8 |
| $C_7$ isoparaffins | 24.4 | 17.6 | 27.5 | 14.8 | 21.0 | 5.6 | 22.6 |
| $C_{8+}$ isoparaffins | 4.4 | 6.4 | 5.2 | 5.5 | 9.2 | 17.4 | 6.7 |
| $C_{5+}$ olefins | 1.2 | 0.7 | 2.1 | 3.8 | 1.9 | 5.7 | 1.3 |
| Cyclopentanes | 9.8 | 4.1 | 4.8 | 7.7 | 6.5 | 7.5 | 3.7 |
| Cyclohexanes | 2.5 | 0.9 | 3.9 | 1.4 | 0.8 | 10.8 | 3.8 |
| Aromatics | 32.8 | 45.7 | 31.2 | 37.0 | 31.7 | 30.5 | 32.3 |
| Unidentified | 1.7 | 2.5 | 1.7 | 0.3 | 1.6 | 4.4 | 2.8 |
| Total, wt % | 100.0 | 100.0 | 100.0 | 100.0 | 100.0 | 100.0 | 100.0 |
| incl. $C_6$ hydrocarbons | 19.0 | 14.6 | 17.8 | 17.0 | 17.8 | 9.0 | 20.6 |
| incl. $C_7$ isoparaffins | 24.4 | 17.6 | 27.5 | 14.8 | 21.0 | 5.6 | 22.6 |
| incl. naphthalenes and alkyl naphthalenes | 0.9 | 0.7 | 0.9 | 0.1 | 1.0 | 0.1 | 1.1 |
| incl. benzene | 1.2 | 1.7 | 1.8 | 1.9 | 1.5 | 0.7 | 2.4 |
| benzene ratio to total aromatics, % | 3.7 | 3.7 | 5.8 | 5.1 | 4.7 | 2.3 | 7.4 |
| n-hexane, conversion, wt % | 64.6 | 84.9 | 64.5 | 91.6 | 72.5 | none** | 62.3 |
| n-heptane, conversion, wt % | 89.8 | 98.1 | 89.0 | 97.3 | 97.3 | 90.1 | 88.7 |

*P (normal paraffins), I (isoparaffins), O (olefins), N (naphthenes), A (aromatics)
**Normal hexane is not present in the feedstock used in experiment No. 6.

TABLE 6

Conditions and main parameters of liquid hydrocarbon product free of dissolved gases ($C_{5+}$ product) in examples Nos. 8-11***

| | Example No. | | | |
|---|---|---|---|---|
| | 8 | 9 | 10 | 11 |
| Hydrocarbon fraction | B | D | C | A |
| Oxygenate | methanol | ethanol | DME | methanol |
| Olefin-containing fraction | A | C | D | A |
| Catalyst | A | B | C | A |
| Weight hourly space velocity, $h^{-1}$ | 1.1 | 0.9 | 0.7 | 0.3 |
| Total catalyst weight, grams | 4713 | 4357 | 4316 | 4713 |
| Pressure, bar | 22 | 22 | 40 | 27 |
| Feed supply temperature, ° C. | | | | |
| $R_{101}$ | 390 | 340 | 410 | 370 |
| $R_{201}$ | 390 | 340 | 420 | 370 |
| $R_{301}$ | 390 | 340 | 430 | 370 |
| % of oxygenate substitution with olefin-containing fraction | 80.5 | 63.2 | 36.8 | 77.7 |
| Oxygenate, distribution over reaction zones, wt % | | | | |
| $R_{101}$ | 100 | 100 | 100 | 100 |
| $R_{201}$ | 0 | 0 | 0 | 0 |
| $R_{301}$ | 0 | 0 | 0 | 0 |
| Olefin-containing fraction, distribution over reaction zones, wt % | | | | |
| $R_{101}$ | 30 | 20 | 10 | 25 |
| $R_{201}$ | 30 | 20 | 20 | 20 |
| $R_{301}$ | 40 | 60 | 70 | 55 |

TABLE 6-continued

Conditions and main parameters of liquid hydrocarbon product free of dissolved gases ($C_{5+}$ product) in examples Nos. 8-11***

| | Example No. | | | |
|---|---|---|---|---|
| | 8 | 9 | 10 | 11 |
| Catalyst, distribution over reaction zones, wt % | | | | |
| $R_{101}$ | 22 | 15 | 25 | 22 |
| $R_{201}$ | 33 | 35 | 30 | 33 |
| $R_{301}$ | 45 | 50 | 45 | 45 |
| Feed composition, wt % | | | | |
| Hydrocarbon fraction, wt % | 75.9 | 37.7 | 78.9 | 70.8 |
| Oxygenate, wt % | 3.8 | 5.2 | 8 | 5.3 |
| Olefin containing fraction, wt % | 20.3 | 57.1 | 13.1 | 23.9 |
| Total, wt % | 100.0 | 100.0 | 100.0 | 100.0 |
| Main process parameters | | | | |
| Liquid HC product yield, wt %** | 63.4 | 66.9 | 66 | 57.2 |
| Liquid product RON | 97.7 | 97.2 | 97.5 | 98.4 |
| Aromatics fraction, wt % | 58.3 | 56.4 | 58.4 | 58.7 |
| Benzene fraction, wt % | 3.7 | 3.1 | 3.8 | 2.6 |
| $C_8$ aromatics fraction, wt % | 18 | 17.4 | 17.5 | 16.6 |
| $C_8$ aromatics ratio to total aromatics, % | 30.9 | 30.9 | 30 | 28.3 |

**$C_{5+}$ hydrocarbon yield per hydrocarbon fraction supplied.

***In experiments 8-11, the whole hydrocarbon fraction is distributed to the first reaction zone

TABLE 7

Composition of stabilized liquid hydrocarbon product used in examples Nos. 1-7

| Detailed hydrocarbon composition, wt % | 1 | 2 | 3 | 4 | 5 | 6 | 7 (comparative) |
|---|---|---|---|---|---|---|---|
| $C_1$-$C_4$ hydrocarbons | 3.6 | 4.2 | 3.5 | 3.8 | 4.8 | 4.5 | 4.8 |
| n-pentane | 4.9 | 4.3 | 5.1 | 6.3 | 5.5 | 4.3 | 5.3 |
| n-hexane | 3.0 | 1.3 | 3.7 | 1.6 | 1.5 | 1.9 | 3.3 |
| n-heptane | 0.8 | 0.2 | 0.7 | 0.2 | 0.3 | 0.8 | 0.9 |
| Normal $C_{8+}$ paraffins | 0.3 | 0.1 | 0.4 | 1.0 | 0.3 | 1.1 | 1.0 |
| Isopentane | 6.7 | 8.4 | 6.1 | 10.7 | 9.0 | 4.9 | 6.6 |
| $C_6$ isoparaffins | 6.7 | 6.8 | 6.9 | 8.6 | 9.3 | 4.3 | 8.4 |
| $C_7$ isoparaffins | 23.5 | 16.9 | 26.5 | 14.2 | 20.0 | 5.3 | 21.5 |
| $C_{8+}$ isoparaffins | 4.2 | 6.1 | 5.0 | 5.3 | 8.8 | 16.6 | 6.4 |
| $C_{5+}$ olefins | 1.2 | 0.7 | 2.0 | 3.7 | 1.8 | 5.4 | 1.2 |
| Cyclopentanes | 9.4 | 3.9 | 4.6 | 7.4 | 6.2 | 7.2 | 3.5 |
| Cyclohexanes | 2.4 | 0.9 | 3.8 | 1.3 | 0.8 | 10.3 | 3.6 |
| Aromatics | 31.6 | 43.8 | 30.1 | 35.6 | 30.2 | 29.1 | 30.7 |
| Unidentified | 1.7 | 2.4 | 1.6 | 0.3 | 1.5 | 4.3 | 2.8 |
| Total, wt % | 100.0 | 100.0 | 100.0 | 100.0 | 100.0 | 100.0 | 100.0 |
| incl. $C_6$ hydrocarbons | 18.3 | 14.0 | 17.2 | 16.4 | 16.9 | 8.6 | 19.6 |
| incl. $C_7$ isoparaffins | 23.5 | 16.9 | 26.5 | 14.2 | 20.0 | 5.3 | 21.5 |
| incl. naphthalenes and alkyl naphthalenes | 0.9 | 0.7 | 0.9 | 0.1 | 1.0 | 0.1 | 1.0 |
| incl. benzene | 1.2 | 1.6 | 1.7 | 1.8 | 1.4 | 0.7 | 2.3 |
| Product yield*, wt % | 77.6 | 75.8 | 76.5 | 77.0 | 77.9 | 85.2 | 75.2 |

*Yield of stabilized liquid hydrocarbon product (stable gasoline after gaseous product separation) per hydrocarbon fraction supplied.

Observations

Reduction of Oxygenate Consumption

It has been found out that the task of reducing oxygenates consumption for production of gasoline or aromatic compound concentrates can be solved through partial substitution of oxygenates with low-demand olefin-containing fractions. This approach allows reducing oxygenates consumption while maintaining the yield and quality of the product.

Comparative example 7 shows that co-processing of hydrocarbon fraction and oxygenates (without involvement of olefin-containing fractions) allows to achieve $C_{5+}$ hydrocarbon product fraction yield above 70% with product RON of about 88. Co-processing of hydrocarbon fractions and oxygenates (without involving olefin-containing fractions) often allows to obtain high-RON gasolines with high product yields. However, such oxygenates as methanol, ethanol, dimethyl ether are sparsely available at the refineries as a cheap feedstock. If no oxygenate source can be found as a component of by-product or semi-finished product of the refinery, it has to be purchased externally at marketable product prices. This shall increase the production cost per marketable gasoline unit and make the production logistics more complicated.

At the same time, the proposed method allows for partial substitution of oxygenates with a source of diluted olefins (olefin-containing fractions). In examples 1-6 and 8-12, the olefin-containing fractions act as partial substitute for feedstock oxygenates.

Percentage of oxygenates substituted with olefin-containing fractions is calculated according to formulas (4)-(6) in page 3 of this Description. The invention examples show that it is possible to substitute 37 to 84% oxygenate with olefin-containing fractions to obtain RON of liquid hydrocarbon product above 90.

The provided formulas (4)-(6) may apply to the known methods of co-processing hydrocarbon fractions and oxygenates (without involving olefin-containing fractions) into gasoline. In this case, formulas (4)-(6) allow to calculate the quantity (molar flow, mol/h) of oxygenate in the known method, which can be substituted with available olefin-containing fractions without impairment of quality and product yield.

Use of Low-Demand Hydrocarbon Fractions

According to Table 1, hydrocarbon fractions A-D used in examples 1-5 are characterized by high content of $C_6$ hydrocarbons (benzene-forming fraction, 23-46 wt %) and $C_7$ isoparaffins (26-38 wt %). Such hydrocarbon fractions may not be used as adequate feedstock for catalytic reforming processes or conventional isomerization. Specifically, processing of feedstock with high content of $C_6$ hydrocarbons by known methods may result in a product with benzene content of 5 wt % and higher. At the same time, high content of $C_7$ isoparaffins in the feedstock in the known processes may result in the product RON drop below 85. Presence of cycloparaffins in hydrocarbon fractions A-D also prevents their processing into high-octane gasoline components by conventional isomerization method.

Examples 1-4 demonstrate that the suggested method allows providing benzene content below 2.0 wt % even when using hydrocarbon fractions containing more than one third of benzene-forming fractions ($C_6$ hydrocarbons content in hydrocarbon fractions A-C reaches 36-46 wt %). In this case, despite of high content of $C_7$ hydrocarbons that are hard to process into high-octane components by the known methods, it is possible to achieve the product RON above 90.

Example 5 shows the case of processing hydrocarbon fraction E. This hydrocarbon fraction represents the feedstock suitable for catalytic reforming. Unlike hydrocarbon fractions A-D, this feedstock is characterized by low content of $C_6$ hydrocarbons (1.2 wt %) and $C_7$ isoparaffins (5.6 wt %). In this case, the proposed method allows to achieve target product yield above 80 wt % per feed supplied and benzene content in the product below 1 wt %.

Possibility to Use Olefin-Containing Fractions without Preliminary Separation of Hydrogen It has been found out that the proposed method allows using olefin-containing fractions with increased hydrogen content as a feedstock. At the same time, the proposed method does not require additional separation of hydrogen from the olefin-containing fraction.

Specifically, examples 1, 4-6 and 8-12 use olefin-containing fractions with hydrogen content of 0.5 to 8 wt %. In the given case, the olefin-containing fractions were supplied to the reaction zones without hydrogen pre-separation from them.

This result is important because fuel gases often contain olefins simultaneously with noticeable amounts of hydrogen. But the presence of hydrogen in the olefin source may lead to side reactions.

Specifically, during preliminary studies outside the recommended range of conditions, it was observed that inclusion of 0.5 to 8 wt % of hydrogen in the olefin-containing fractions would reduce the liquid hydrocarbon product yield by 3-6 wt % (while maintaining the same molar flow of olefins and feed supply rate). Besides, when hydrogen content in the olefin-containing fractions was 2.3 to 8 wt %, a decrease in high-octane alkyl benzenes portion in the product by 0.6-2.3 wt % was observed. Such results could be observed due to side process of feedstock olefins hydrogenation.

The proposed method application made it possible to suppress such negative effects, also by means of oxygenate feeding in the first reaction zone, while simultaneously feeding olefin-containing fractions into three reaction zones. At the same time, the portion of the olefin containing fraction delivered to the third reaction zone is greater than the portion of the olefin-containing fraction distributed to the first or second reaction zones.

Invention examples 1, 4-6 and 8-12 show no decrease in the yield of liquid hydrocarbon product or decrease in the alkyl benzene content of the product due to hydrogen inclusion in the olefin-containing feedstock fractions.

This widens the possibilities of the method in the involvement of low-value sources of $C_2$-$C_4$ olefins in production of gasolines or aromatic compound concentrates.

Possibility to Use Olefin-Containing Fractions without Preliminary Increasing the Olefins Concentration The possibility of using low-demand olefin-containing fractions as a feedstock for production of gasoline or aromatic compound concentrates was also considered. Refineries produce olefin-containing fractions used as fuel. These are catalytic cracking gases, gases from delayed coker unit, olefin-containing fuel gases of different origin, etc. The content and composition of olefins in such streams is too low for commercially viable recovery. At the same time, the price of streams burned as fuel is minimal. Involvement of such olefin-containing fractions in production of gasoline or aromatic concentrates significantly increases the stream value for a company.

Examples 1-6 and 8-12 demonstrate the possibility of using olefin-containing fractions with olefin content below 50 wt %. Specifically, it is possible to use gaseous sources of olefins with olefin content of 10 wt % (or higher). This allows reducing significantly the unit production costs as compared to methods where highly concentrated olefin sources or chemically pure olefins are used.

The proposed method allows to use diluted olefins instead of highly concentrated sources of olefins (e.g. pure ethylene). This allows using semi-finished products and by-products of existing petrochemical production facilities as a source of olefins. Among them are dry gases of catalytic cracking, various fuel gases with olefin content from 10 to 50 wt %.

Oxygenate-Free Liquid Hydrocarbon Product

The proposed method allows to obtain liquid hydrocarbon product free of oxygenates. Oxygenates, specifically ethanol, are often used as octane-increasing additives in compounding of motor gasoline. However, the maximum content of oxygenates in commercial gasoline is strictly regulated. Liquid hydrocarbon products obtained in examples 1-6 and 8-12 do not contain oxygenates, but have a high octane number according to the research method (product RON above 90). Such combination of properties allows using maximum permissible amount of oxygenates when compounding commercial gasoline based on the product obtained by the proposed method.

Possibility to Avoid Gaseous Products Recycling

The proposed method is found to skip the gaseous products recycling. All the proposed method application examples show a conversion rate for feedstock $C_2$-$C_4$ olefins higher than 98 wt %. Such high degree of conversion in one pass through the reactor allows avoiding gaseous product recycling for the purpose of deeper processing of feedstock olefins.

Reduction of Benzene Portion in Liquid Hydrocarbon Product

It is found that, while producing gasolines, the proposed method provides for reduction of the benzene portion in liquid hydrocarbon product to 0.7-1.9 wt %. At the same time, the ratio of benzene to the sum of aromatic hydrocarbons is reduced to 2.2-5.8 wt %. This is achieved even when $C_6$ hydrocarbons make up more than one third of the feedstock hydrocarbon fraction composition. Specifically, the used hydrocarbon fractions A-C contained from 36 to 46 wt % of $C_6$ hydrocarbons. The $C_6$ hydrocarbons are benzene precursors in the known catalytic processes of gasoline production. Conversion of hydrocarbon fraction with high benzene precursors content by the known methods would result in a product with high benzene content. It is difficult to use such product in motor gasoline compounding, where maximum benzene content is strictly limited. Specifically, catalytic reforming of hydrocarbon fraction containing 36-46 wt % of $C_6$ hydrocarbons would result in a product with benzene content more than 5-10 wt %, which is much higher than the result obtained by the proposed method.

Enhancement of n-Hexane and n-Heptane Conversion

Despite high content of $C_6$ hydrocarbons and use of cheaper feedstock (oxygenate part substitution with olefin-containing gases) the proposed method allows to enhance n-hexane and n-heptane conversion.

Specifically, n-hexane conversion reaches 91.6 wt % and n-heptane conversion—97.3 wt %.

Reduction of Naphthalenes and Alkylnaphthalenes Content

At the same time, content of naphthalenes and alkylnaphthalenes in liquid hydrocarbon product is maintained or reduced. Specifically, naphthalenes and alkylnaphthalenes content is achieved at the level of 0.1 wt % in example 4. Naphthalenes and alkylnaphthalenes are undesirable components in commercial gasoline, particularly because of their high boiling points and tendency to crystallize.

Possibility to Produce Low-Benzene Aromatics Concentrates

In process of obtaining aromatic compound concentrates, it is also possible to produce low-benzene aromatics concentrates. There are known several conventional methods for production of AHF (aromatic hydrocarbon fractions, or aromatic hydrocarbons concentrate). The aromatics concentrates may be obtained, e.g., in process of catalytic reforming, or as oil refining by-products. The produced aromatics concentrates may be used as high-octane base in motor gasoline compounding. Unfortunately, the known methods often result in aromatics concentrate production with extremely high benzene content (benzene content in liquid hydrocarbon product of more than 15 wt %). The high benzene content in aromatics concentrate drastically limits its use in blending motor gasolines, since maximum benzene content in fuels is strictly controlled.

However, the proposed method of obtaining aromatic compound concentrates allows producing low-benzene AHF (aromatics fractions). The liquid hydrocarbon product obtained in examples 8-11 contains 56-66 wt % of aromatic hydrocarbons with the benzene content of 3-4 wt %. Hence, the proposed method allows obtaining AHF with significantly lower benzene content as compared to conventional methods.

Possibility to Produce Aromatics Concentrate with High $C_8$ Alkylbenzenes Content In process of obtaining aromatic compound concentrates, it is also possible to produce aromatics concentrates with higher content of $C_8$ alkylbenzenes. Examples 8-11 demonstrate that the proposed method allows to achieve $C_8$ alkylbenzenes content in liquid hydrocarbon product of 17-18 wt %. At the same time, the portion of $C_8$ aromatics relative to the total aromatics reaches 28-31 wt %. Average RON of $C_8$ alkylbenzenes reaches 112, which makes them the attractive components for compounding high-octane gasolines.

Distributed Feed of Hydrocarbon Fraction

It has been observed that change in hydrocarbon fraction supply to the reaction zones allows to control several process parameters. Specifically, distribution of hydrocarbon fraction in two or three reaction zones allows to additionally increase the yield and/or formation selectivity of $C_{5+}$ hydrocarbons (hydrocarbons with five or more carbon atoms). Besides, in case of distributed feed of hydrocarbon fraction in several reaction zones, cracking of isoparaffins with two or more alkyl substituents with formation of lower $C_1$-$C_4$ hydrocarbons can be suppressed. The hydrocarbon fraction distribution into multiple reaction zones may also result in reduced dealkylation of alkylaromatic hydrocarbons.

Specifically, example 12 shows the possibility of distributing hydrocarbon fraction into multiple reaction zones. Example 12 repeats the conditions of example 1, except for changes in the hydrocarbon fraction distribution. In example 1, the hydrocarbon fraction distribution into reaction zones $R_{101}/R_{201}/R_{301}$ was 100/0/0 wt %. Example 12 maintains the same feed mass rates as example 1, but the hydrocarbon fraction is distributed over the three reaction zones in the ratio of 50/25/25 wt %. As a result, the product yield is increased by 3 wt % per hydrocarbon fraction supplied (from 74.8 to 77.7 wt % for liquid hydrocarbon product free of dissolved gases).

In example 12, the aromatics content in the product (liquid hydrocarbon product free of dissolved $C_1$-$C_4$ gases) is reduced by 3.2 wt % as compared to example 1 (from 32.8 to 29.6 wt %). Normally, a decrease in the product octane number is expected when aromatics concentration in the product reduces. However, it was found out that the product RON in example 12 was virtually the same as the one of the product in example 1 (90.6 and 90.8, respectively). This effect can be explained by cracking reduction of high-octane $C_5$-$C_8$ isoparaffins (isoparaffins with individual octane numbers according to the research method above 72) as a result of distributed hydrocarbon fraction supply to several reaction zones.

It is also possible to distribute the whole hydrocarbon fraction stream only to the second or only to the third reaction zone, if necessary.

What is claimed:

1. A method of producing a liquid hydrocarbon product containing aromatic compounds, where three streams are used as feedstocks: a first stream includes a hydrocarbon fraction, a second stream includes an oxygenate, and a third stream includes an olefin-containing fraction, the method comprising:

a. the olefin-containing fraction comprising one or more olefins from the group including ethylene, propylene, normal butylenes, and isobutylene, in total amount from 10 to 50 wt %;

b. three reaction zones filled with a zeolite catalyst are used, thereby defining a first reaction zone, a second reaction zone and a third reaction zone;

c. the first stream is fed to at least one reaction zone;

d. the second stream is fed to the first reaction zone;

e. the third stream is fed to the three reaction zones and distributed between the three reaction zones, with the mass fraction of the third stream distributed to the third reaction zone being higher than the mass fraction of the third stream distributed to each of the previous reaction zones; and, f. wherein a product stream from the first reaction zone is supplied to the second reaction zone, and a product stream from the second reaction zone is supplied to the third reaction zone.

2. The method as per the claim 1, where the liquid hydrocarbon product containing aromatic compounds is represented by gasoline, with an aromatic compound content is less than 46 wt %, or the liquid hydrocarbon product containing aromatic compounds is represented by aromatics concentrate, with the aromatic compound content is higher than 46 wt %.

3. The method as per the claim 1, where the first stream is fed to the first reaction zone.

4. The method as per the claim 1, where the third stream is distributed between the three reaction zones as follows: 10-30 wt %/20-35 wt %/40-70 wt %.

5. The method as per the claim 1, where the hydrocarbon fraction contains normal paraffins in the amount of 15-24 wt %, isoparaffins in the amount of 28-56 wt %, naphthenes in the amount of 22-40 wt %, the rest are aromatic hydrocarbons and olefins.

6. The method as per the claim 1, where the hydrocarbon fraction contains from 0 to 80 wt % of $C_6$ hydrocarbons, preferably from 23 to 46 wt % of $C_6$ hydrocarbons.

7. The method as per the claim 1, where the hydrocarbon fraction contains from 0 to 70 wt % of $C_7$ isoparaffins, preferably from 26 to 50 wt % of $C_7$ isoparaffins.

8. The method as per the claim 1, where the hydrocarbon fraction may be selected from the group including straight-run gasoline, natural stable gasoline, light gas condensate, gasoline fraction with boiling range of about 62-85° C., raffinate, and mixtures thereof.

9. The method as per the claim 1, where the first olefin-containing fraction has a mass fraction of $C_{5+}$ hydrocarbons from 0 to 10.0 wt %.

10. The method as per the claim 1, where the olefin-containing fraction may include $C_{5+}$ olefins, such as pentenes, hexenes.

11. The method as per the claim 1, where the olefin-containing fraction has a volume fraction of hydrogen sulfide from 0.0 to 0.005%.

12. The method as per the claim 1, where the olefin-containing fraction may include hydrocarbon components other than olefins, such as methane, ethane, propane, butane, and may contain nonorganic gases, such as hydrogen, nitrogen.

13. The method as per the claim 1, where the olefin-containing fraction comprises 0.5-8.0 wt % of hydrogen, preferably 2.3-8.0 wt % of hydrogen.

14. The method as per the claim 1, where the olefin-containing fraction may include $C_{5+}$ olefins, such as pentenes, hexenes.

15. The method as per the claim 1, where the olefin-containing fraction is selected from the group including dry gas of catalytic cracking, wet gas of catalytic cracking, other catalytic cracking gases and their fractionation products, exhaust gas from the coker unit, Fischer-Tropsch synthesis gases, and mixtures thereof.

16. The method as per the claim 1, where the olefin-containing fraction is selected from the group including propane-propylene fractions, butane-butylene fractions, thermal cracking gas, visbreaking gas, hydrocracking exhaust gases, pyrolysis gas, catalytic reforming exhaust gas, and mixtures thereof.

17. The method as per the claim 1, where the olefin-containing fraction includes dry gas of catalytic cracking and contains from 25 to 40 wt % of $C_2$-$C_4$ olefins.

18. The method as per the claim 1, where the oxygenate is selected from the group including aliphatic alcohols, such as methanol, ethanol, crude methanol, technical methanol, ethanol; simple esters, dimethyl ether; and mixtures thereof, including mixtures with water.

19. The method as per the claim 1, where the oxygenate may contain impurities, such as aldehydes, carboxylic acids, compound ethers.

20. The method as per the claim 1, where the process pressure is from 1.5 to 4.0 MPa, preferably from 2.2 to 2.7 MPa.

21. The method as per the claim 1, where the weight hourly space velocity is 0.5-10 $h^{-1}$.

22. The method as per the claim 1, where the stream temperature at the inlet to the first/second/third reaction zones is 340-450° C./340-450° C./340-450° C.

23. The method as per the claim 1, where the weight hourly space velocity is from 0.5 to 10 $h^{-1}$.

24. The method as per the claim 1, where the stream temperature at the inlet to the first/second/third reaction zones is 340-370° C./340-370° C./340-370° C.

25. The method as per the claim 1, where the weight hourly space velocity is from 0.9 to 10 $h^{-1}$.

26. The method as per the claim 1, where the stream temperature at the inlet to the first/second/third reaction zones is 390-450° C./390-450° C./390-450° C.

27. The method as per the claim 1, where the weight hourly space velocity is from 0.1 to 0.9 $h^{-1}$.

28. The method as per the claim 1, where the catalyst distribution over the reaction zones is 15-25 wt %/30-33 wt %/35-50 wt % of the total catalyst amount for the first/second/third reaction zones, respectively.

29. The method as per the claim 1, where the mass of the catalyst distributed to each subsequent reaction zone is higher than the catalyst mass distributed to each previous reaction zone.

30. The method as per the claim 1, where the hydrocarbon fraction is 38-79 wt % of the feedstock.

31. The method as per the claim 1, where the olefin-containing fraction is 13-57 wt % of the feedstock.

32. The method as per the claim 1, where the oxygenate is 3.8-8.0 wt % of the feedstock.

33. The method as per the claim 1, wherein the zeolite catalyst includes:

a. ZSM-5 type zeolite with modulus $SiO_2/Al_2O_3$ from 43 to 95, in the amount of 65 to 80 wt %;

b. sodium oxide in the amount of 0.04 to 0.15 wt %;

c. zinc oxide in the amount of 1.0 to 5.5 wt %;

d. oxides of rare earth elements in total amount of 0.5 to 5.0 wt %; and, e. a binder comprising silicon dioxide, aluminum oxide or mixtures thereof.

34. The method as per the claim 33, where the zeolite catalyst is free of platinum metals.

35. The method as per the claim 33, where the rare earth elements are selected from the group including lanthanum, praseodymium, neodymium, cerium, and mixtures thereof.

36. The method as per the claim 1, where a reaction takes place in a gas phase in a static layer of the zeolite catalyst.

* * * * *